US010900279B2

(12) United States Patent
Chorine et al.

(10) Patent No.: US 10,900,279 B2
(45) Date of Patent: Jan. 26, 2021

(54) FRAMELESS GLASS DOOR OR WINDOW ARRANGEMENT WITH DRIP GROOVE

(71) Applicant: AGC GLASS EUROPE, Louvain-la-Neuve (BE)

(72) Inventors: Nicolas Chorine, Court-Saint-Etienne (BE); Olivier Bouesnard, Ittre (BE); Pavel Cumpelik, Krupka (CZ); Miroslav Spacek, Jizni mesto (CZ)

(73) Assignee: AGC GLASS EUROPE, Louvain-la-Neuve (BE)

( * ) Notice: Subject to any disclaimer, the term of this patent is extended or adjusted under 35 U.S.C. 154(b) by 0 days.

(21) Appl. No.: 16/068,817

(22) PCT Filed: Dec. 22, 2016

(86) PCT No.: PCT/EP2016/082277
§ 371 (c)(1),
(2) Date: Jul. 9, 2018

(87) PCT Pub. No.: WO2017/121599
PCT Pub. Date: Jul. 20, 2017

(65) Prior Publication Data

US 2019/0024445 A1 Jan. 24, 2019

(30) Foreign Application Priority Data

Jan. 12, 2016 (EP) ..... 16150851
Jan. 21, 2016 (EP) ..... 16152227

(51) Int. Cl.
*E06B 7/14* (2006.01)
*E06B 3/66* (2006.01)
(Continued)

(52) U.S. Cl.
CPC ..... *E06B 7/14* (2013.01); *E06B 3/025* (2013.01); *E06B 3/66* (2013.01); *E06B 3/66342* (2013.01)

(58) Field of Classification Search
CPC ..... E06B 7/14; E06B 3/025; E06B 3/5445; E06B 3/5436; E06B 3/66; E06B 3/66342; E06B 3/66347
(Continued)

(56) References Cited

U.S. PATENT DOCUMENTS 1,099,499 A * 6/1914 Hackett ..... E06B 7/14 312/101
2,052,244 A * 8/1936 Pertz ..... E06B 3/645 52/786.13
(Continued)

FOREIGN PATENT DOCUMENTS

DE 3438834 4/1986
DE 3721112 A1 * 1/1989 ..... E06B 3/5427
(Continued)

OTHER PUBLICATIONS

International Search Report dated Feb. 6, 2017 in PCT/EP2016/082277 filed Dec. 22, 2016.

*Primary Examiner* — Patrick J Maestri
*Assistant Examiner* — Joseph J. Sadlon
(74) *Attorney, Agent, or Firm* — Oblon, McClelland, Maier & Neustadt, L.L.P.

(57) ABSTRACT

The present invention relates to a frameless glass door or window arrangement comprising a static frame and a movably mounted or stationary casement, wherein the casement further comprises a multiple glazing and at least one drip groove provided on the glazing, and wherein that at least one drip groove is provided between the plan defined by the external surface of the external glass plate and the plan
(Continued)

defined by the internal surface of the internal glass plate of the glazing.

21 Claims, 4 Drawing Sheets

(51) Int. Cl.
*E06B 3/663* (2006.01)
*E06B 3/02* (2006.01)

(58) Field of Classification Search
USPC ..... 52/209, 786.13
See application file for complete search history.

(56) References Cited

U.S. PATENT DOCUMENTS 2,525,717 A * 10/1950 Ottenheimer ..... E06B 3/64 52/172
2,765,886 A * 10/1956 Gross ..... A47B 47/0008 312/140
3,425,163 A * 2/1969 Horgan, Jr. ..... E05D 15/0665 49/413
3,486,288 A * 12/1969 Pyne ..... E06B 3/08 52/844
3,555,736 A * 1/1971 Koch, Jr. et al. ..... B60J 1/2011 49/504
3,919,815 A * 11/1975 Alabaster ..... E06B 1/02 52/97
4,198,254 A * 4/1980 Laroche ..... C09J 123/08 156/107
4,334,398 A * 6/1982 Grether ..... E06B 3/66 52/786.11
4,364,213 A * 12/1982 Biesanz, Sr. ..... E04C 2/041 52/309.17
4,625,479 A * 12/1986 Giguere ..... E06B 3/645 52/202
4,912,898 A * 4/1990 Holmes ..... E04C 2/54 52/204.593
4,945,680 A * 8/1990 Giguere ..... E06B 1/70 49/467
5,014,477 A * 5/1991 MacDonald ..... E04B 2/967 52/204.593
5,044,121 A * 9/1991 Harbom ..... E06B 3/325 49/401
H000975 H * 11/1991 Selkowitz ..... B32B 17/10 52/172
5,065,557 A * 11/1991 Laplante ..... E04B 2/96 52/235
5,083,405 A * 1/1992 Miller ..... E04B 1/7612 52/204.591
5,333,428 A * 8/1994 Taylor ..... B44C 5/08 264/254
5,356,675 A * 10/1994 Unger ..... E04B 1/0046 428/33
5,373,672 A * 12/1994 Schulz ..... B32B 17/10045 52/235
5,579,616 A * 12/1996 Farag ..... E04B 2/96 52/204.5
5,619,828 A * 4/1997 Ver Meer ..... E06B 1/6015 29/897.312
6,158,372 A * 12/2000 Erskine ..... B63B 19/00 114/177
6,401,428 B1 * 6/2002 Glover ..... E06B 3/24 52/786.1
6,581,342 B1 * 6/2003 Tavivian ..... B32B 17/10 156/106
6,745,527 B1 * 6/2004 Sherman ..... E04B 2/96 52/235
6,868,648 B2 * 3/2005 Glover ..... E06B 3/24 52/786.1
7,134,247 B2 * 11/2006 Ting ..... E06B 3/4609 52/235
7,424,794 B2 * 9/2008 Baranowski ..... E04B 5/12 52/302.1
7,637,058 B2 * 12/2009 Lai ..... E05D 15/0656 49/408
7,841,139 B2 * 11/2010 Dampierre ..... E06B 3/273 52/204.68
8,402,716 B2 * 3/2013 Tinianov ..... E06B 3/66333 49/501
8,490,349 B2 * 7/2013 Lutzner ..... E06B 7/14 52/204.51
9,068,358 B2 * 6/2015 MacDonald ..... E04F 13/0805
9,663,946 B2 * 5/2017 Frederick ..... E04B 2/90
9,879,420 B2 * 1/2018 Joseph ..... E04B 2/7401
2004/0168387 A1 * 9/2004 Nelson ..... E06B 1/62 52/344
2014/0113541 A1 * 4/2014 Drier, II ..... F24F 7/00 454/222

FOREIGN PATENT DOCUMENTS

DE 89 13 572 U1 10/1990
DE 197 33 154 A1 2/1999
EP 0 910 720 A1 4/1999
GB 2 032 985 A 5/1980
GB 2142357 A * 1/1985 ..... E04B 2/90
WO WO 98/02632 A1 1/1998

* cited by examiner

FRAMELESS GLASS DOOR OR WINDOW ARRANGEMENT WITH DRIP GROOVE

FIELD OF THE INVENTION

The invention relates to a frameless glass door or window arrangement comprising a static frame and a casement made of a glazing with a drip groove to avoid the run-off of water or condensate, by accumulation and wetting, through the frameless door or window casement arrangement, between the static frame and the casement.

DESCRIPTION OF PRIOR ART

Openable window and door arrangements separating the interior from the exterior of buildings are usually designed and built up with a sealing means which obstructs the space between the static part—static frame—and the mobile part—casement—of the arrangement, to prevent water and air penetration. However, even when the arrangement is in closed position, it is hardly completely tight. Indeed, water may flow between the mobile part and static part of the frame and tends to drip along the lower edge of the mobile part and to flow into the space in between. This is the reason why drip grooves are formed in the mobile part of frames, to prevent the run-off of water or condensate. The groove will stop run-off by causing the formation of drops. A drainage duct is provided in the static part of the frame for receiving the drops that fall therein, to evacuate the water to the exterior of the building. The space between the static frame and the casement, making the link between the drip groove and the draining duct, must be decompressed to allow for recuperation and drainage of water. It is called decompression chamber.

The drip grooves are also known in the field of frameless glass doors and windows.

As for framed arrangements, in closed position, a sealing means obstructs the space between the mobile part and the static part. Despite this sealing means, some water may flow between these two parts and infiltrate into the arrangement. For this reason, a drainage duct is formed in the static part for draining the water that flows along the sealing means to the exterior of the building.

It has been discovered that the water may not fall necessarily directly into the drainage duct. The water tends to run-off by accumulation and wetting along the edge of the lower part of the casement without falling in the drainage duct and keeps flowing its way further between the mobile part and the static part.

Document EP 0910720 discloses a frameless glass door or window arrangement, with a drip groove provided on an edge element protruding outside the glazing of the casement. Such an embodiment, while drastically reducing the frame proportion in the casement, has the drawback of providing a protruding drip groove element outside of the arrangement which is obviously fragile, and aesthetically not pleasant. Also, the drip groove element is subjected to weather and external conditions leading to its deterioration.

SUMMARY OF THE INVENTION

It is an object of the invention to provide a frameless glass door or window arrangement with a static frame and a movably mounted or stationary casement comprising a glazing and a drip groove on it which is safe, secure, and durable.

To this end, the invention relates to a frameless glass door or window arrangement according to claim 1.

By static frame, it is meant any component which is fixedly connected to a building wall or façade, and which allows to make the connection with the openable part of the window or door arrangement. The static frame is usually made of wood, metal, plastic, or a combination of them.

By casement, it is meant the movably mounted or stationary component which is connected to the static frame through a hardware means, and fills the opening defined by the static frame. The hardware means include all the devices, fittings, or assemblies, necessary to operate the window or door as intended. The casement is made of an infill panel, such as glass or glazing in case of a glass window or door arrangement, and optionally a mobile frame whose composition is similar to the static frame, which is mounted on the edges of the infill panel.

By frameless glass door or window arrangement, it is meant that the casement of the door or window arrangement has a higher transparent surface than a standard one by elimination some or all the frame elements of the casement. In an embodiment of the present invention, a portion of the edge of the glazing is directly exposed to the decompression chamber between the static frame and the casement. Another embodiment of a frameless glazed door or window as defined in the present document, is such that the glazing is not framed at all, meaning that the casement shape and volume is fully defined by the glass plates of the glazing.

By weather sealing means, it is meant any device positioned between the static frame and the casement to prevent or reduce air and water passage between the static frame and the casement. Weather sealing means are typically made of rubber or plastic. They are usually running all along the arrangement periphery and are usually multiple for one arrangement, meaning that several sealing gaskets run in parallel to each other along the arrangement periphery. When multiple, the weather sealing means allow to separate the space between static frame and casement in one or several chambers. The chamber which is linked to the drainage duct, which allows for water evacuation, is called the decompression chamber.

In the present invention, the infill panel of the casement is a multiple glazing, preferably a double or a triple glazing. By multiple glazing, it is meant any assembly of at least two glass plates which are separated from each other and secured together by at least a sealing means. Usually, the glass plates will also be separated from each other by at least a spacer which generally runs around between the glass plates, and which is filled with a desiccative material. The sealing means can be of various types, typically polysulfide, polyurethane or Silicone. In addition, interspaces defined between glass sheets and spacers are usually filled with dry air or an inert gas, such as argon or krypton, to reduce heat exchange from one side of the glazing to the other side.

By external glass plate, it is meant the plate of the glazing, which is located on the outer side of the glazing and therefore, in contact with the exterior atmosphere and possibly the rain. Thus, the term "internal" refers to a plate extending internally of the glazing, in contact with the interior of the building.

The external surface of the external glass plate is defined as the surface of the external glass plate which is directed towards the exterior atmosphere; and the internal surface of the internal glass plate is defined as the surface of the internal glass plate which is directed towards the interior of the building.

Glass plates will be chosen among all flat glass technologies, among them: float clear, extra-clear or coloured glass, optionally with a low-emissivity or a solar control coating, optionally tempered and/or laminated, glass products with dynamic properties, so-called active glass, such as electrochromic glass, painted (or partially painted) glass and combinations thereof.

By drip groove, it is meant a cavity of a certain height and width aiming at converting water run-off into droplets that will be evacuated by a drainage duct. According to the invention, at least one drip groove is provided on the glazing, between the plane defined by the external surface of the external glass plate and the plane defined by the internal surface of the internal glass plate.

The arrangement according to claim 1 is inventive. Indeed, in standard window or door arrangements, a drip groove is provided on the mobile frame of the casement. The one skilled in the art had no reason to provide a drip groove on the glazing because there is no or very limited water penetration in the cavity defined between the glazing and the mobile frame. For frameless window or door arrangements, again, there was no reason, for the one skilled in the art to go backwards and provide a drip groove located inside the glazing. The above prior art reference shows a frameless arrangement with a drip groove which copies the standard window configuration by providing a drip groove as an outwardly extending projection of the profile located at the bottom of the glazing. However, such a protruding drip groove is fragile, aesthetically not pleasant and subjected to weathering agents like UV and water.

Interestingly it was found that the drip groove according to the invention can still be effective as a protection against water infiltration while being protected by the glass plates. It is achieved by positioning at least one drip groove between the plane defined by the external surface of the external glass plate of the glazing and the plane defined by the internal surface of the internal glass plate. This position of the drip groove is advantageous over the above prior art in that the drip groove does not protrude from the glazing anymore. On the one hand, it improves the aesthetics of the glazing what is key for frameless applications. On the other hand, the drip groove is protected from shocks and weathering agents. Preferably, the drip groove is provided between the plane defined by the external surface of the external glass plate and before the hardware means for actuating the window or door arrangement. This enables to drain water before affecting the actuating means. In this case, besides the aesthetics and protection advantages, the drip groove allows evacuating infiltrated water before it reaches the hardware means, which might otherwise be damaged by contact with water.

Preferably, the drip groove is located on the edge of the glazing, and fully inside the glazing. Located inside the glazing means here in the volume surrounded by two glass plates of the glazing, including the volume of the glass plates themselves. This allows to go one step further in the integration of the drip groove with a significant positive impact on aesthetics, as the drip groove device is completely concealed between the glass plates of the glazing, and therefore it is not visible to building occupants, what is perfectly in line with the objective of a frameless glass door or window arrangement. There is also a significant technical benefit of providing the drip groove inside the glazing: it is completely protected from mechanical shocks or weathering agents like Ultraviolet (UV) rays, by the glass plates which are very solid and partially opaque to UVs. In addition, this integration allows to spare material and therefore to spare money, as there is no need of adding any material outside the glazing to create the drip groove. full In an embodiment of the present invention, at least one drip groove is provided by digging the edge of at least one glass plate of the glazing. Such digging process is known in the glass industry. However, this process has never been used in the past to form a drip groove for a window or door arrangement.

In another embodiment of the invention, at least one drip groove is provided on an edge-terminating element. By edge-terminating element, it is meant any component or assembly of components positioned at the edge of the glazing and fastened to it. This edge-terminating element can be of various types. Among the possibilities, it can be a sealing means, for instance the sealing means used to fasten the glass plates together, or it can be a profile running along the glazing edge, or even a combination of both.

In the variant of this embodiment wherein the glazing is a double glazing with an external and an internal glass plates, at least one drip groove is positioned on an edge-terminating located between the external and the internal glass plates, or between external glass plate and a profile for anchoring hardware means for actuating the arrangement.

In the variant of this same embodiment wherein the glazing is a triple glazing with an external, a central and an internal glass plates, at least one drip groove is positioned on an edge-terminating element located between the external glass plate and the central glass plate, and/or between the central glass plate and a profile for anchoring hardware means for actuating the arrangement.

When the drip groove is provided on an edge-terminating element between two glass plates, the drip groove is preferably adjacent to at least one glass surface. For instance, considering the triple glazing configuration detailed above with a drip groove provided on an edge-terminating element located between the external and the central glass plates, the drip groove is preferably adjacent to the internal surface of the external glass plate or adjacent to the external surface of the central glass plate, or even adjacent to both the internal surface of the external glass plate and the external surface of the central glass plate. The technical advantage is that there is less processing of the edge-terminating element needed to provide the drip groove and hence an increase in production efficiency.

It is also preferable to provide the drip groove with a certain height and width, to allow for the drip groove to be really efficient in converting run-off water into droplets. The height of the drip groove is defined as the dimension of the groove measured in the plane parallel to the glass plates. The width of the drip groove is defined as the dimension of the groove measured in the plane perpendicular to glass plates.

The height of the drip groove is generally at least 1 mm, preferably at least 2 mm, more preferably at least 4 mm, most preferably at least 5 mm. The maximum height of the drip groove will be determined on a case by case basis depending on parameters like the size of the door or window, aesthetical aspects and will be such that the mechanical properties of the glazing remain not significantly affected.

The width of the drip groove is generally at least 1 mm, preferably at least 2 mm, more preferably at least 3 mm, most preferably at least 5 mm. The maximum width of the drip groove will be lower than the thickness of the glass plate or of the edge-terminating element, depending in which of these two components the drip groove is located.

Generally, the drip groove extends along the periphery of the glazing. Preferably, it extends at least along the bottom edge of the glazing, more preferably only along the bottom edge of the glazing. Indeed, for instance by sake of easiness, having the same edge-terminating element all around the glazing periphery might be advantageous. In this case, the drip groove may extend all around the periphery of the glazing. Nevertheless, the bottom edge is the edge of the glazing for which the drip groove achieves its function to convert water run-off water into droplets that are recuperated by a drainage duct system. Therefore, it is advantageous that the drip groove extends at least along the bottom edge of the glazing. It is even more preferred that the drip groove is provided only all along the bottom edge of the glazing, and not in lateral and top edges, in order to avoid stagnant water that could degrade the edge-terminating element or even the glazing by the time.

The frameless glass window or door arrangement has a static frame which preferably comprises a draining duct means to allow for the evacuation of water accumulating between the static frame and the casement of the arrangement. The draining duct has a slope that is sufficient to allow an easy flow of the droplets to the exterior side of the static frame, i.e., the side that is in contact with the exterior atmosphere.

SHORT DESCRIPTION OF THE DRAWINGS

These and further aspects of the invention will be explained in greater detail by way of example and with reference to the accompanying drawings that in no way are limiting the scope of the present invention and in which.

The figures are not drawn to scale. Generally, identical elements or analogous elements are referenced by the same numbers in the figures. In the claims, the reference numbers are only used in view of a better understanding of the invention and will in no way limit the scope of the claims.

DETAILED DESCRIPTION

Figure 1:
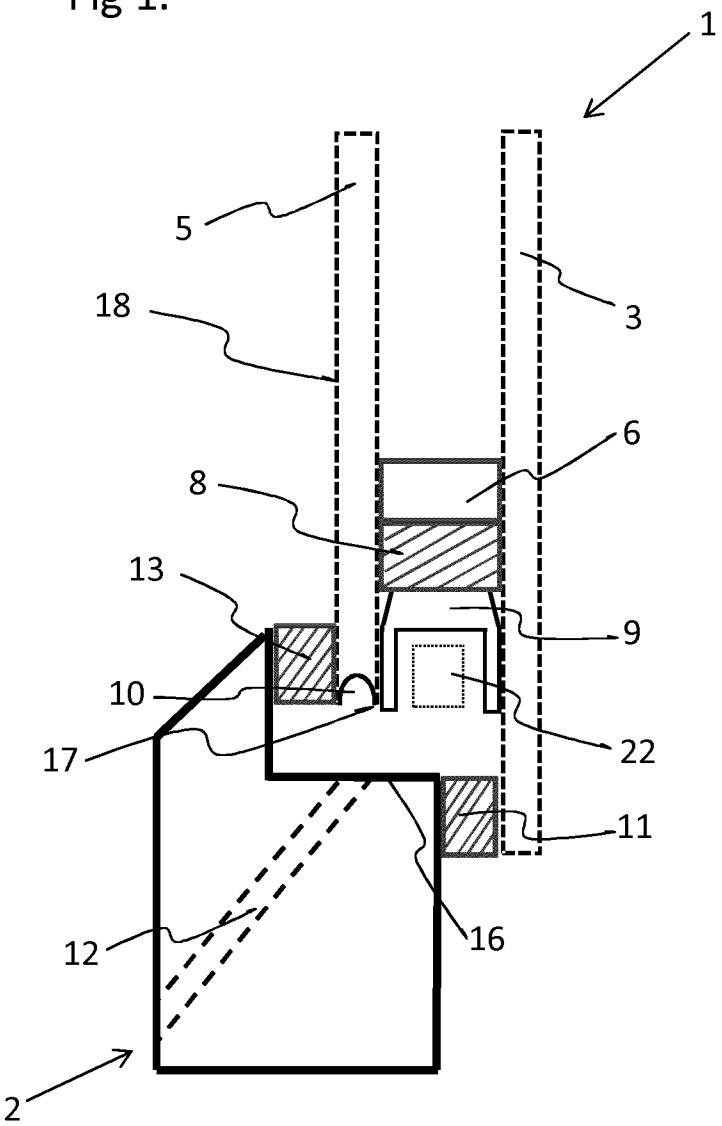
FIG. 1 is a cross-section view of a first embodiment of the frameless arrangement of the invention with a glazing with two glass plates.

In reference to FIG. 1, the frameless window or door arrangement comprises a casement 1 and a static frame 2. The static frame 2 is provided with a shoulder 16 for receiving the casement 1 located internally of the static frame 2.

In this embodiment, the casement 1 comprises a double glazing with an internal glass plate 3 and an external glass plate 5. The glass plates are spaced apart by a spacer 6. There is also a sealing means 8 which encompasses the spacer to seal the glazing.

A weather sealing means 13 is provided between the static frame 2 and the external glass plate 5 of the glazing, in the shoulder 16, to obstruct the space between the casement 1 and the static part 2 when the window is closed. Another sealing means 11 is provided between the static frame 2 and the internal glass plate 3, which is longer than the external plate 5. The cavity defined between the two weather sealing means is the decompression chamber. As the edge 17 of the glazing is directly exposed to the decompression chamber, it is a frameless arrangement.

There is a profile 9 for anchoring the hardware means 22 for actuating the window or door arrangement, extending between the two glass plates 5 and 3, and which is fastened, generally glued. The profile 9 illustrated is U-shaped, but is in any way not limited to that specific shape. Any shape that can fulfil the function of receiving the actuating means is suitable.

The drip groove 10 is provided at the edge 17 of the glazing, fully inside the glazing. Located inside the glazing has the meaning detailed above. Accordingly, the volume beyond the level of the edge 17 of the external glass plate 5 is not inside the glazing as it is not surrounded by two glass plates.

In reference to FIG. 1, a drip groove 10 is provided by digging the bottom edge 17 of the external plate 5 of the glazing all along the bottom edge 17. The drip groove 10 is a concave groove open towards the ground. In case of water or condensate flowing between seal 13 and the outer face 18 of the external glass plate, the water reaching the drip groove 10 will be converted into droplets falling into the shoulder 16 of the static frame 2. A draining duct 12 is provided in the static frame 2, from the shoulder 16 to evacuate the water.

Figure 2:
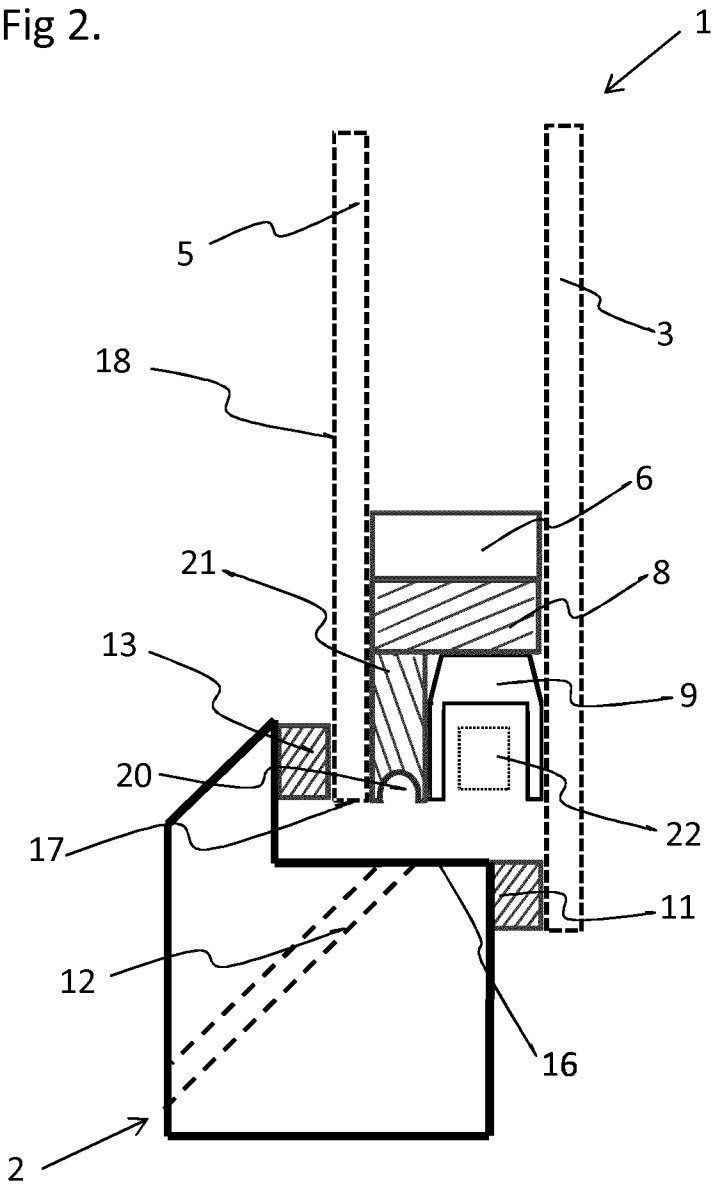
FIG. 2 is a cross-section view of a second embodiment of the frameless arrangement of the invention with a glazing with two glass plates.

The frameless window or door arrangement of FIG. 2 comprises the same technical elements as FIG. 1. But in this embodiment, the drip groove 20 is provided on an edge-terminating element 21, between the external glass plate 5 and the profile 9. In case of water or condensate flowing between seal 13 and the outer face 18 of the external glass plate and elapsing by capillarity along the bottom edge 17 of the external glass plate, the water reaching the drip groove 10 will be transformed into droplets. These droplets will fall into the draining duct 12 provided in the static frame 2, from the shoulder 16, to evacuate the water.

Figure 3:
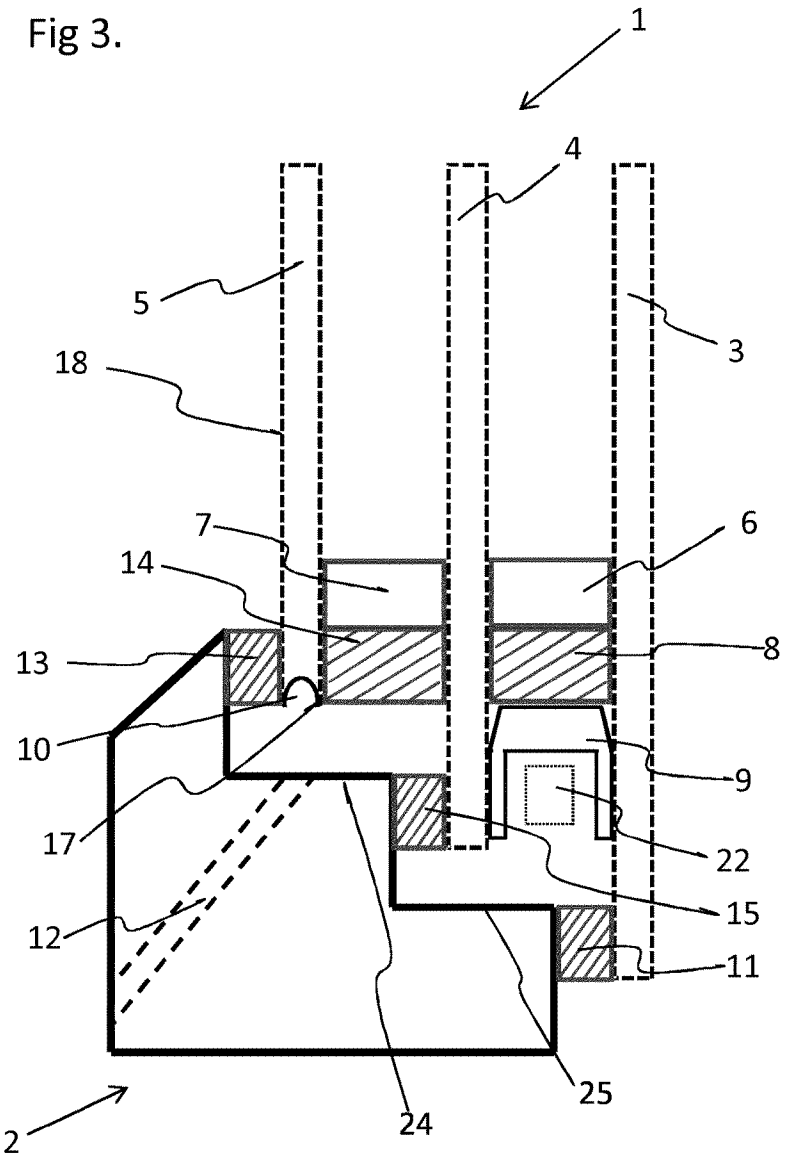
FIG. 3 is a cross-section view of a third embodiment of the frameless arrangement of the invention with a glazing with three glass plates.

In reference to FIG. 3, the frameless window or door arrangement comprises a casement 1 and a static frame 2.

In this embodiment, the casement 1 comprises a triple glazing: an external glass plate 5, an internal glass plate 3 and a central glass plate 4 between the external glass plate 5 and the internal glass plate 3. The static frame 2 is provided with two shoulders 24 and 25 for receiving the casement 1 located internally of the static frame 2.

The glass plates are spaced apart by spacers 6 and 7 and are fastened to each other by sealing means 8 and 14.

The frameless window comprises, as in FIGS. 1 and 2, a first weather sealing means 13 and a second weather sealing means 11. In the embodiment of FIG. 3, there is a third weather sealing means 15 which is provided between the static frame 2 and the central glass plate 4, which is longer than the external plate and smaller than the internal plate. The third weather sealing means also aims at obstructing the space between the casement 1 and the static part 2 when the window is closed.

There is a profile element 9 for anchoring the hardware means 22 for actuating the window, extending between the two glass plates 4 and 3, and which is fastened, generally glued, by encompassing the spacer 6 and the seal 8.

The drip groove 10 is provided at the edge of the glazing, fully inside the glazing. Located inside the glazing has again the meaning detailed above. Accordingly, when the drip groove is between the external glass plate 5 and the central glass plate 4, the volume beyond the level of the edge 17 of the external glass plate 5 is not inside the glazing as it is not surrounded by the glass plates 4 and 5. When the drip groove is between the central glass plate 4 and the internal glass plate 3, the volume beyond the level of the edge 27 of the central glass plate 4 is not inside the glazing as it is similarly not surrounded by the glass plates 3 and 4.

In FIG. 3, a drip groove 10 is provided on the lower edge 17 of the most external plate 5 of the glazing. The drip groove 10 is a concave groove open towards the ground. In case of water or condensate flowing between seal 13 and the outer face 18 of the external glass plate, the water reaching the drip groove 10 will be transformed into droplets falling into the shoulder 24 of the static frame 2. A draining duct 12 is provided in the static frame 2, from the shoulder 24, to evacuate the water.

Figure 4:
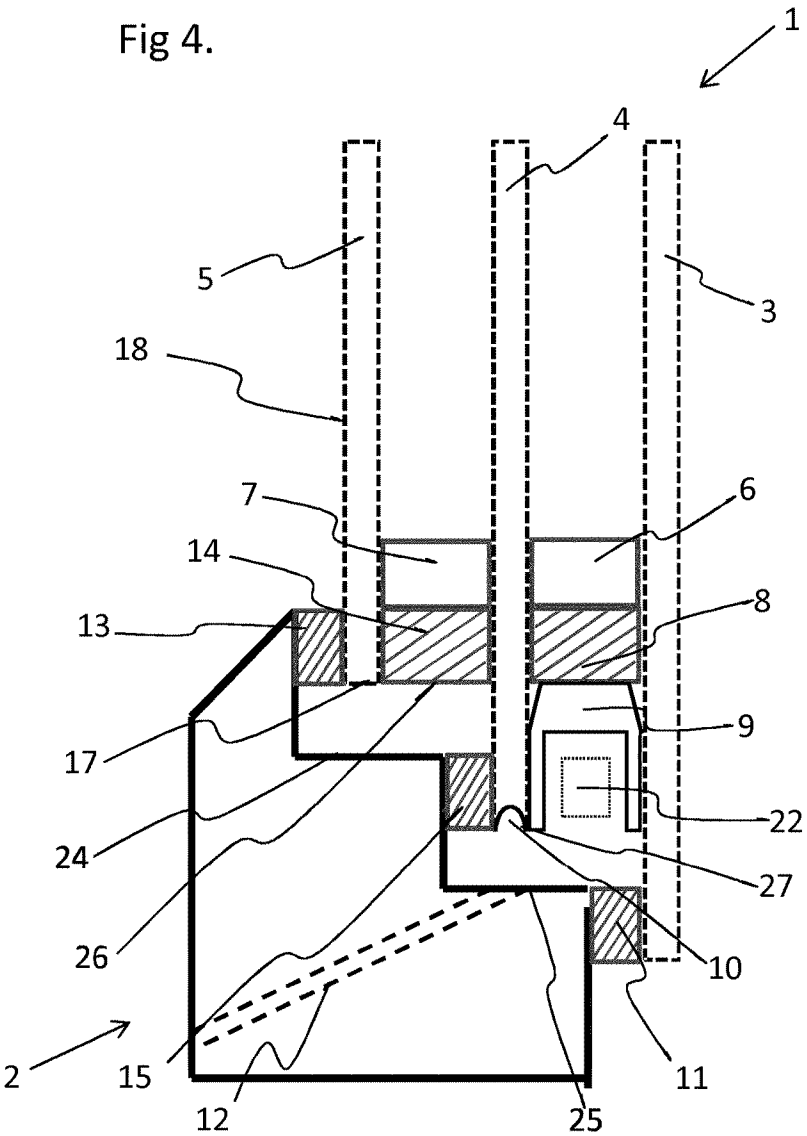
FIG. 4 is a cross-section view of a fourth embodiment of the frameless arrangement of the invention with a glazing with three glass plates.

The frameless window or door arrangement of FIG. 4 comprises the same technical elements as FIG. 3. But in this embodiment, the drip groove 10 is provided on the bottom edge 27 of the central glass plate 4. In case of water or condensate flowing between seal 13 and the outer face 18 of the most external glass plate 5, often, water elapses by capillarity along the lower face 17 of the most external glass plate 5. The water tends to keep flowing its way further along the lower face 26 of the central glass plate 4 and to flow between the seal 15 and the central glass plate 4. After, the water reaches the drip groove 10 provided on the lower edge 27 of the central glass plate 4 and will be transformed into droplets. These droplets will fall into the draining duct 12 provided in the static frame 2, from the shoulder 25, to evacuate the water.

Figure 5:
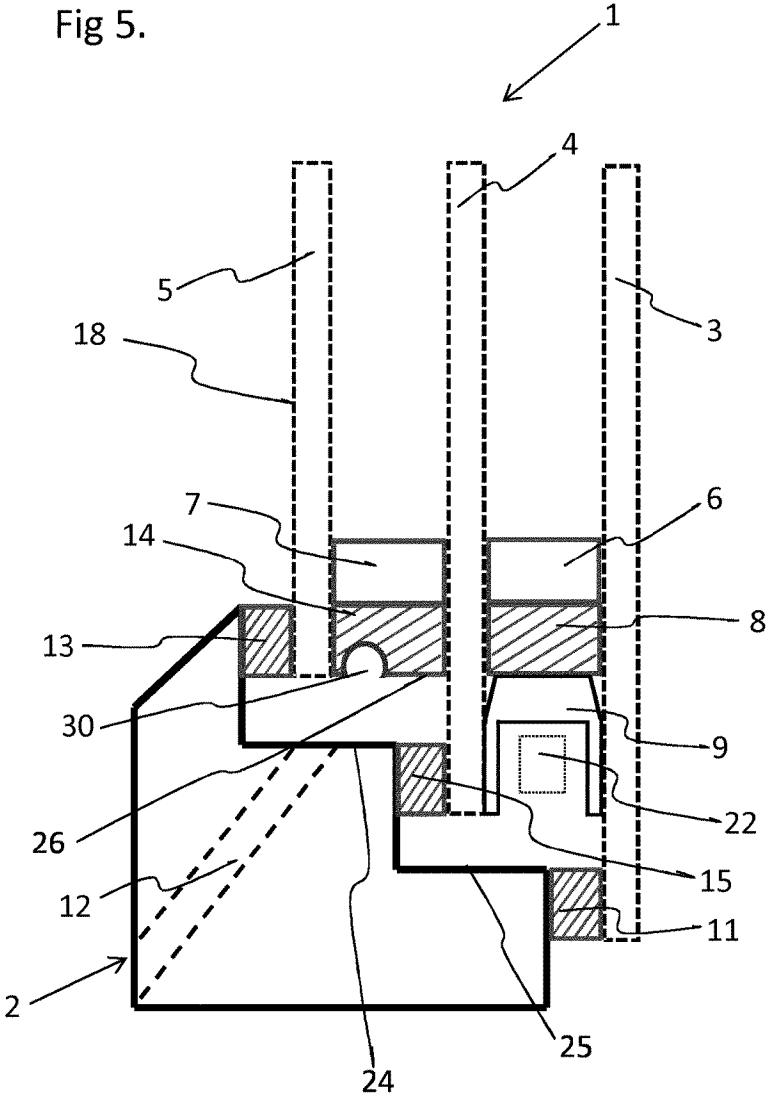
FIG. 5 is a cross-section view of a fifth embodiment of the frameless arrangement of the invention with a glazing with three glass plates.

In reference to FIG. 5, the frameless window or door arrangement comprises the same technical elements as FIG. 3. However, in this embodiment, the drip groove 30 is provided on the sealing means 14 comprised between the most external glass plate 5 and central glass plate 4. It is worth to mention that in case that the sealing means 14 would have been combined with another component to give an edge-terminating element, the drip groove would have been provided on the edge-terminating element. In case of water or condensate flowing between seal 13 and the outer face 18 of the most external glass plate 5, and elapsing by capillarity along the lower face 17 of the most external glass plate 5, the water reaching the drip groove 30 will be transformed into droplets. These droplets will fall into the draining duct 12 provided in the static frame 2, from the shoulder 24, to evacuate the water.

Figure 6:
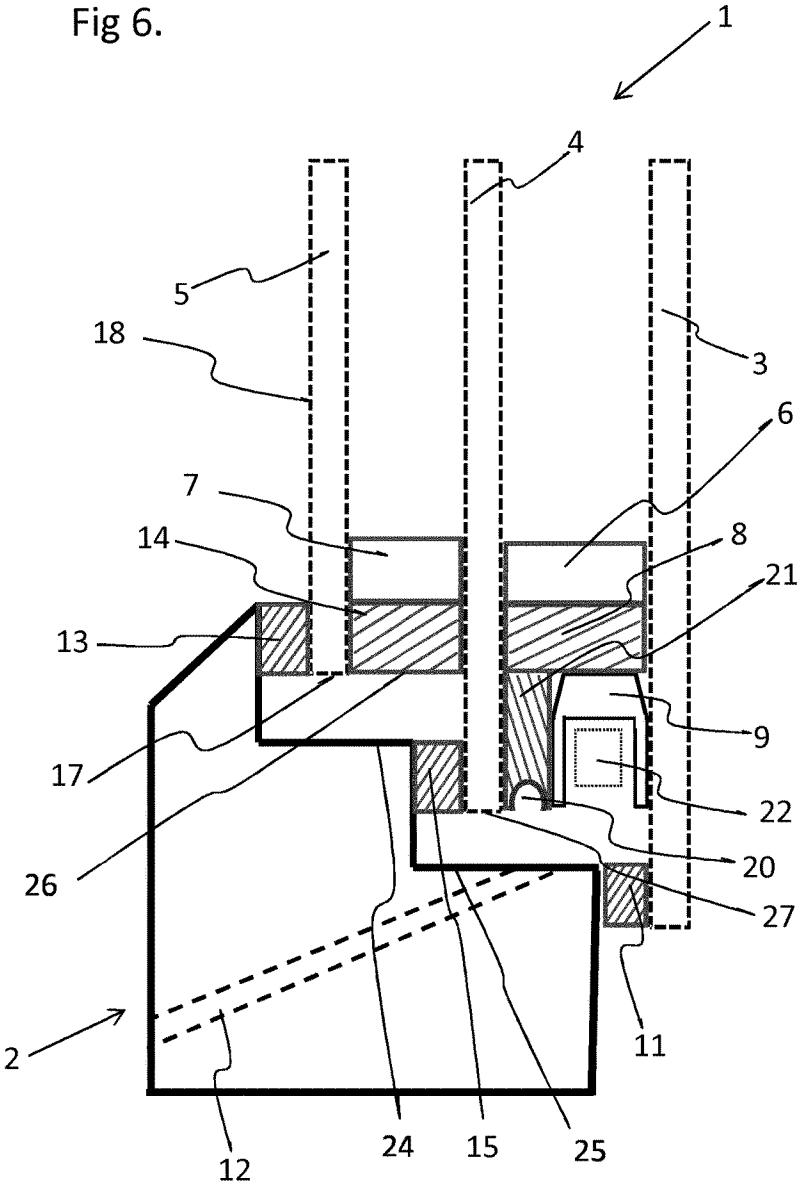
FIG. 6 is a cross-section view of a sixth embodiment of the frameless arrangement of the invention with a glazing with three glass plates.

In the embodiment of FIG. 6, the frameless window or door arrangement comprises the same technical elements as FIG. 3. But in this embodiment, the drip groove 20 is provided on an edge-terminating element 21, between the central glass plate 4 and the profile 9. In case of water or condensate flowing between seal 13 and the outer face 18 of the most external glass plate 5, often, water elapses by capillarity along the lower face 17 of the most external glass plate 5. The water tends to keep flowing its way further to reach the central glass plate 4 and to flow between the fifth seal 15 and the central glass plate 4. Afterwards, the water elapses by capillarity along the lower face 27 of the central glass plate 4, reaching the drip groove 20 which transforms it into droplets. These droplets will fall into the draining duct 12 provided in the static frame 2, from the shoulder 25, to evacuate the water.

Figure 7:
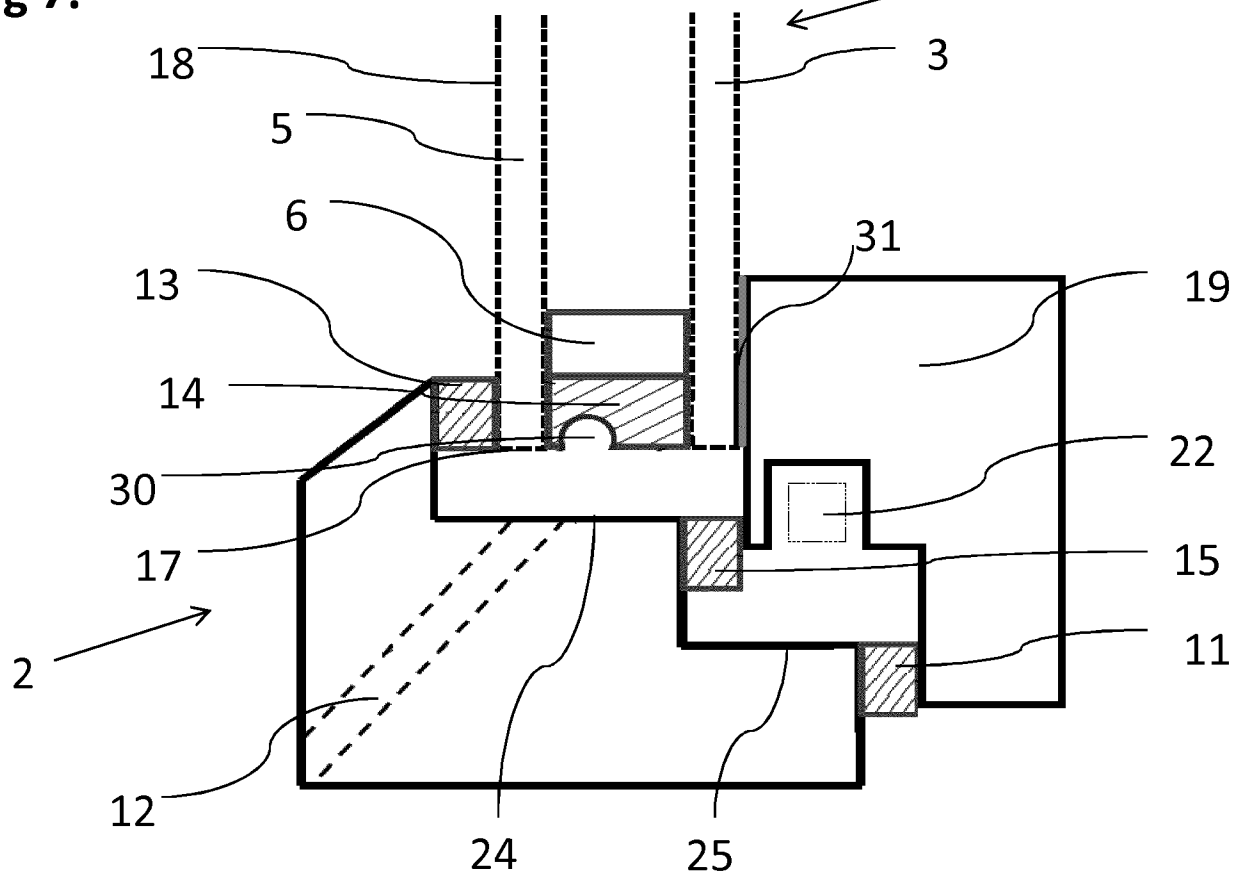
FIG. 7 is a cross-section view of a seventh embodiment of the frameless arrangement of the invention with a glazing with two glass plates.

FIG. 7 shows an alternative frameless window or door arrangement according to the invention. The arrangement comprises a casement 1 and a static frame 2. The static frame 2 is provided with two shoulders 24 and 25 for receiving the casement 1 located internally of the static frame 2.

In this embodiment, the casement 1 comprises a double glazing with an internal glass plate 3 and an external glass plate 5, and a profile element 19 which is glued to the internal glass plate 3 with a sealing means 31. The profile element 19 is used to anchor the hardware means 22 for actuating the window or door arrangement.

The glass plates are spaced apart by a spacer 6. There is also a sealing means 8 which encompasses the spacer to seal the glazing.

A weather sealing means 13 is provided between the static frame 2 and the external glass plate 5 of the glazing, in the shoulder 16, to obstruct the space between the mobile part 1 and the static part 2 when the window is closed. Two other sealing means 11 are provided between the static frame 2 and the profile element 19. The cavity defined between the weather sealing means 13 and 11 is the decompression chamber.

The drip groove 30 is provided at the edge of the glazing, fully inside the glazing. In the embodiment of FIG. 7, the drip groove 30 is provided on the sealing means 14 comprised between the most external glass plate 5 and internal glass plate 3. It is worth to mention that in case that the sealing means 14 would have been combined with another component to give an edge-terminating element, the drip groove would have been provided on the edge-terminating element. In case of water or condensate flowing between seal 13 and the outer face 18 of the external glass plate, the water reaching the drip groove 30 will be converted into droplets falling into the shoulder 24 of the static frame 2. A draining duct 12 is provided in the static frame 2, from the shoulder 24 to evacuate the water.

The invention claimed is:

1. A frameless glass door or window arrangement comprising:

a static frame;

a movably mounted or stationary casement; and a weather sealing means, wherein said casement comprises a multiple glazing with at least an external glass plate and an internal glass plate spaced apart from each other at least by a spacer, wherein the internal and external glass plates are fastened together by a sealing means, wherein the weather sealing means is provided between the static frame and the external glass plate, wherein at least one drip groove is provided on the glazing, and wherein said at least one drip groove is provided within a downward facing edge of the casement between a plane defined by an external surface of the external glass plate and a plane defined by an internal surface of the internal glass plate.

2. The frameless glass door or window arrangement according to claim 1, wherein said at least one drip groove is provided between the plane defined by the external surface of the external glass plate and a hardware means for actuating the arrangement.

3. The frameless glass door or window arrangement according to claim 1, wherein said at least one drip groove is located at an edge of the glazing, and fully inside the glazing.

4. The frameless glass door or window arrangement according to claim 1, wherein said at least one drip groove is provided on an edge-terminating element.

5. The frameless glass door or window arrangement according to claim 4, wherein said at least one drip groove is provided on an edge-terminating element and is adjacent to at least one glass surface.

6. The frameless glass door or window arrangement according to claim 1, wherein said at least one drip groove is provided by digging an edge of either the external glass plate or a central glass plate of the glazing.

7. The frameless glass door or window arrangement according to claim 1, wherein the casement is a double glazing comprising the external glass plate and the internal glass plate, wherein the drip groove is provided on an edge-terminating element.

8. The frameless glass door or window arrangement according to claim 7, wherein the drip groove is provided on an edge-terminating element and between the external plate and a hardware means for actuating the arrangement.

9. The frameless glass door or window arrangement according to claim 1, wherein the casement is a double glazing comprising the external glass plate and the internal glass plate, wherein the drip groove is provided by digging an edge of the external glass plate of the glazing.

10. The frameless glass door or window arrangement according to claim 1, wherein the casement is a triple glazing comprising the external glass plate, a central glass plate and the internal glass plate, wherein the drip groove is provided on an edge-terminating element located between the external Mass plate and the central glass plate.

11. The frameless door or window arrangement according to claim 1, wherein the casement is a triple glazing comprising the external glass plate, a central glass plate, and the internal glass plate, wherein the drip groove is provided on an edge-terminating element located between the central glass plate and a hardware means for actuating the arrangement.

12. The frameless glass door or window arrangement according to claim 1, wherein said at least one drip groove has a height of at least 1 mm.

13. The frameless glass door or window arrangement according to claim 1, wherein said at least one drip groove has a width of at least 1 mm.

14. The frameless glass door or window casement arrangement according to claim 1, wherein said at least one drip groove extends at least along a bottom edge of the glazing.

15. The frameless glass door or window arrangement according to claim 1, wherein the static frame comprises at least one draining duct.

16. The frameless glass door or window casement arrangement according to claim 1, wherein the at least one drip groove has an opening facing a bottom of the glazing.

17. A frameless glass door or window arrangement comprising:

a static frame;

a movably mounted or stationary casement, the casement further comprising a multiple glazing, the multiple glazing including an external glass plate, an internal glass plate, and at least one drip groove provided on the glazing; and a weather sealing means between the static frame and the external glass plate, wherein the external glass plate and the internal glass plate are spaced apart from each other at least by a spacer, wherein said at least one drip groove is provided within a downward facing edge of the casement between a plane defined by an external surface of the external glass plate and a plane defined by an internal surface of the internal glass plate.

18. The frameless glass door or window arrangement according to claim 17, wherein said at least one drip groove is located at an edge of the glazing, and fully inside the glazing.

19. The frameless glass door or window arrangement according to claim 17, wherein said at least one drip groove is provided on an edge-terminating element.

20. The frameless glass door or window arrangement according to claim 17, wherein said at least one drip groove is provided by digging an edge of either the exterior glass plate or a central glass plate of the glazing.

21. The frameless glass door or window casement arrangement according to claim 17, wherein said at least one drip groove extends at least along a bottom edge of the glazing, and wherein the static frame comprises at least one draining duct.

* * * * *